US005487096A

United States Patent [19]

Pearson et al.

[11] Patent Number: 5,487,096

[45] Date of Patent: Jan. 23, 1996

[54] INTEGRATED CIRCUIT WITH REAL TIME, ELAPSED TIME, AND CYCLE COUNTER CLOCKS

[75] Inventors: Ronald W. Pearson, Denton; Kevin E. Deierling, Dallas; Clark R. Williams, Plano, all of Tex.

[73] Assignee: Dallas Semiconductor Corporation, Dallas, Tex.

[21] Appl. No.: 259,421

[22] Filed: Jun. 14, 1994

Related U.S. Application Data

[63] Continuation of Ser. No. 728,230, Jul. 10, 1991, abandoned.

[51] Int. Cl.[6] ..... G06M 3/02

[52] U.S. Cl. ..... 377/15; 377/44; 377/20; 377/32; 364/185; 364/187

[58] Field of Search ..... 377/26, 15, 44, 377/20, 32; 364/184, 185, 187

[56] References Cited

U.S. PATENT DOCUMENTS

| | | | |
|---|---|---|---|
| 4,048,478 | 9/1977 | Miwa et al. | 377/15 |
| 4,168,531 | 9/1979 | Eichelberger et al. | 377/26 |
| 4,383,184 | 5/1983 | McFarland | 307/66 |
| 4,531,064 | 7/1985 | Levine | 377/32 |
| 4,809,221 | 2/1989 | Magliocco et al. | 377/44 |
| 4,815,112 | 3/1989 | Kuze | 377/26 |
| 4,871,982 | 10/1989 | Williams et al. | 331/75 |
| 4,912,435 | 3/1990 | Williams et al. | 331/75 |
| 4,967,108 | 10/1990 | Lee et al. | 307/556 |
| 4,984,291 | 1/1991 | Dias et al. | 455/343 |
| 4,989,261 | 1/1991 | Lee | 455/127 |

*Primary Examiner*—John S. Heyman
*Attorney, Agent, or Firm*—Jenkens & Gilchrist

[57] ABSTRACT

An integrated circuit which includes not only a real time clock, but also an elapsed time counter, and a third counter. The elapsed time counter measures the total number of seconds during which a system has been powered up. The third counter is a "cycle counter," which measures the number of times a power cycle (power-up and power-down) has occurred. Thus, by reading the cycle counter and the elapsed time indicator, the general power history of a system can readily be determined, even if the system itself has totally failed. This integrated circuit is battery backed, and is advantageously combined with a system for which power history must be maintained.

7 Claims, 14 Drawing Sheets

C
TO FIG. 2F
IO_OUT*
NC1
Q
Q*
CLR*
D
C*
C
TO FIG. 2D
43
05
25
45
RTC00
CO*(7:0)
CO(7:0)
SFW02
L2FF02
SFW10
FF2LR
CLK__OUT
MAT_OUT
RTC00
CLK_IN
MAT_IN
TST_CLK
TST00
RTC02
CO*(7:0)
CO(7:0)
SFW04
L2FF04
SFW12
FF2LR
CLK__OUT
MAT_OUT
RTC02
CLK_IN
MAT_IN
TST_CLK
TST02
RTC04
CO*(7:0)
CO(7:0)
SFW06
L2FF06
SFW14
FF2LR
CLK__OUT
MAT_OUT
RTC04
CLK_IN
MAT_IN
TST_CLK
TST04
C1(7:0)
C1*(7:0)
TO FIG. 2D
B
TO FIG. 2C
FROM FIG. 2A

RTC_CLK
ETC_CLK
CC_CLK
READRM
XFER
FF2LR
FF2LE
FF2LC
ETC_RD
CC_RD
RTC_RD
FROM FIG. 2B
FROM FIG. 2A
D
ETCO1
CO*(7:0)
CO(7:0)
SFW08
L2FF08
SFW16
FF2LE
CLK_OUT
MAT_OUT
CLK_IN
MAT_IN
TST_CLK
TSTO1
15
ETCO3
SFW0R
L2FF0R
SFW18
TSTO3
35
CCO0
SFW0C
L2FF0C
SFW1R
TSTO5
05
TO FIG. 2F
FROM FIG. 2C
A

INTEGRATED CIRCUIT WITH REAL TIME, ELAPSED TIME, AND CYCLE COUNTER CLOCKS

This application is a continuation of application Ser. No. 728,230, filed Jul. 10, 1991, now abandoned.

PARTIAL WAIVER OF COPYRIGHT

All of the material in this patent application is subject to copyright protection under the copyright laws of the United States and of other countries. As of the first effective filing date of the present application, this material is protected as unpublished material.

Portions of the material in the specification and drawings of this patent application are also subject to protection under the maskwork registration laws of the United States and of other countries.

However, permission to copy this material is hereby granted to the extent that the owner of the copyright and maskwork rights has no objection to the facsimile reproduction by anyone of the patent document or patent disclosure, as it appears in the United States Patent and Trademark Office patent file or records, but otherwise reserves all copyright and maskwork rights whatsoever.

CROSS-REFERENCE TO OTHER APPLICATIONS

The following applications of common assignee contain at least some drawings in common with the present application, and are believed to have effective filing dates identical with that of the present application, and are all hereby incorporated by reference:

DSC-319: Ser. No. 727,618, filed Jul. 10, 1991, entitled "Integrated Counter/RAM Array Layout";

DSC-322: Ser. No. 727,619, filed Jul. 10, 1991, entitled "Timekeeping Chip with Clock-to-Memory Update Only on Read Signal";

DSC-324: Ser. No. 727,638, filed Jul. 10, 1991, entitled "Integrated Circuit with Scratchpad Copy to Any Portion of a Page";

DSC-352: Ser. No. 727,255, filed Jul. 10, 1991 continued as Ser. No. 103,724, filed Aug. 9, 1993, entitled "Electronic Key with Three Modes of Automatic Self-Disablement";

DSC-353: Ser. No. 727,639, filed Jul. 10, 1991, now U.S. Pat. No. 5,297,099, issued Mar. 22, 1994, entitled "Integrated Circuit with Both Battery-Powered and Signal-Line-Powered Areas";

DSC-356: Ser. No. 727,273, filed Jul. 10, 1991, now U.S. Pat. No. 5,166,545, issued Nov. 4, 1992, entitled "Power-On-Reset Circuit"; all of which are hereby incorporated by reference.

BACKGROUND AND SUMMARY OF THE INVENTION

The present invention relates to integrated circuits and methods for keeping track of the power history of a system or subsystem.

Many high-reliability systems, and particularly military systems, will use a special electrolytic device (a "sodium cell") to measure accumulated time under power. By inspection of this device, maintenance technicians can determine when an electronic component has exceeded its rated time in service. However, because this component must be visually inspected, it is not widely used in other types of systems.

The integrated circuit of the presently preferred embodiment includes not only a real time clock, but also an elapsed time counter and a third counter. The elapsed time counter measures the total number of seconds during which a system has been powered up. The third counter is a "cycle counter," which measures the number of times a power cycle (power-up and power-down) has occurred. Thus, by reading the cycle counter and the elapsed time indicator, the general power history of a system can readily be determined, even if the system itself has totally failed. This integrated circuit, in the presently preferred embodiment, is battery backed, and is advantageously combined with a system for which power history must be maintained.

The presently preferred embodiment contains also contains a large number of other innovative features, which are described in detail in the accompanying specification. However, it must be understood that the claimed inventions can be practiced without the other disclosed innovations (although some such alternative embodiments may not confer the full benefits of the preferred embodiment).

BRIEF DESCRIPTION OF THE DRAWINGS

The present invention will be described with reference to the accompanying schematic drawings.

DESCRIPTION OF THE PREFERRED EMBODIMENTS

Figure 1A:
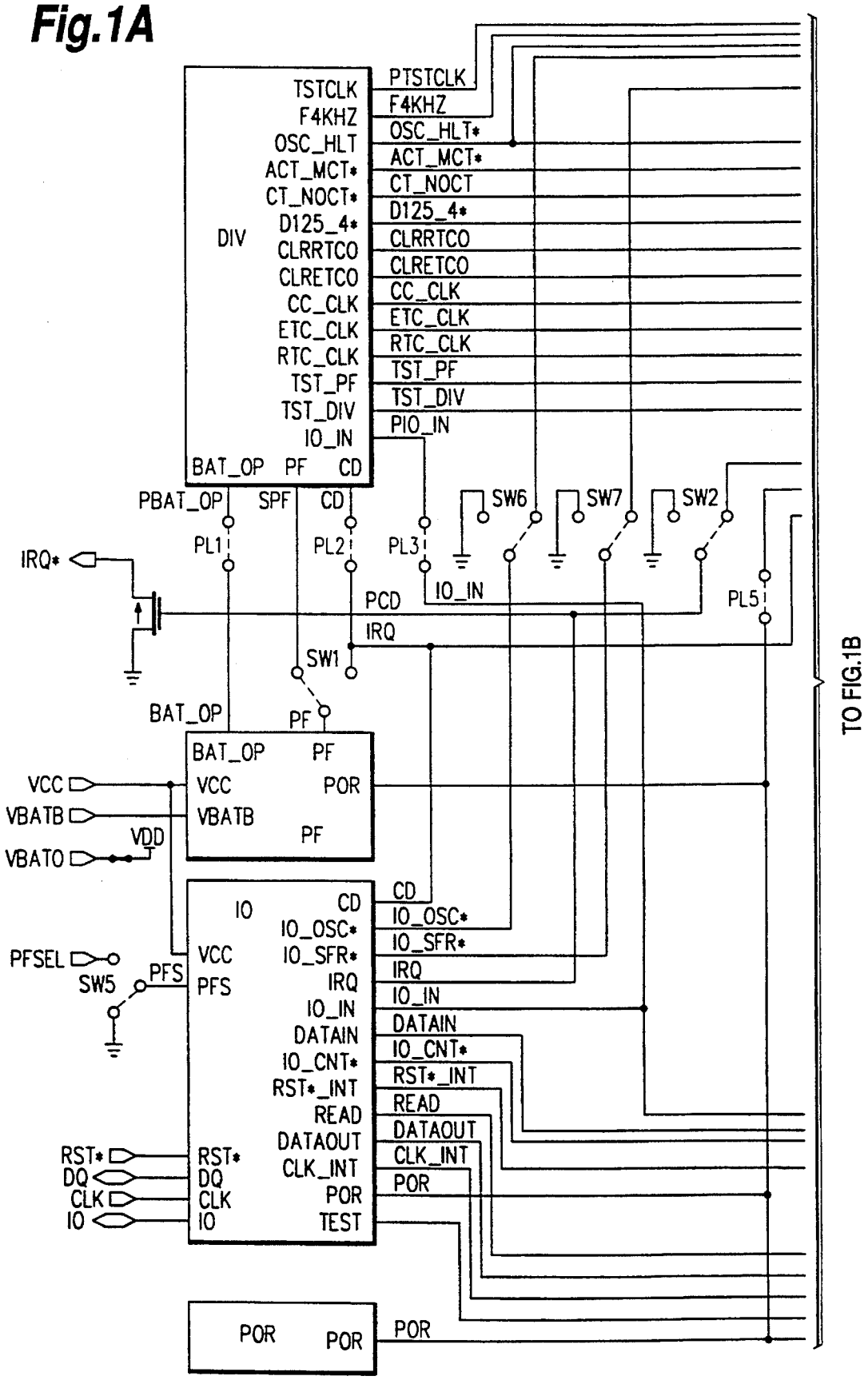
FIGS. 1A–1B show the high-level circuit organization of the chip used in the presently preferred embodiment.
Figure 1B:
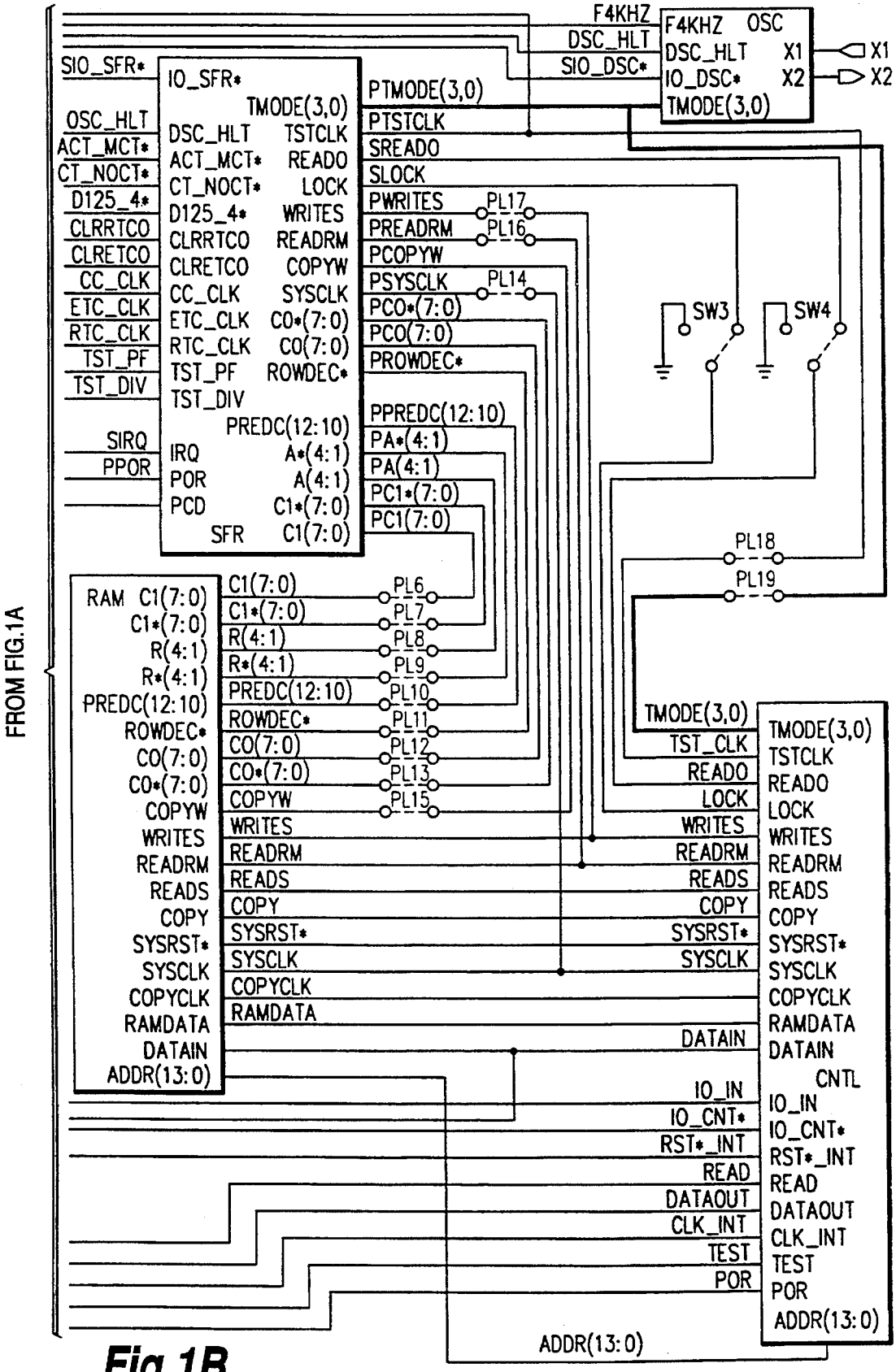

FIGS. 1A–1B are a functional block diagram of a preferred embodiment module containing secure memory with serial communication plus three counters which provide time, elapsed time, and power-up/down cycle counts. The module may be battery powered (VBATO at lefthand edge in FIG. 1) and include a crystal oscillator (OSC and X1, X2 at righthand edge) to provide uninterrupted time ticks. The counters incorporate access collision (update versus user read/write) avoidance. The module has both one-wire and three-wire serial communication.

The module of FIGS. 1A–1B includes blocks IO (serial input/output), PF (power failure detection), POR (power-on-reset), RAM (4K bits of memory), SFR (Special Function Registers: the three counter chains plus alarms and access logic), OSC (crystal oscillator), DIV (for dividing the output of OSC), and CNTL (control). The 4K bits of-memory in RAM are organized into 16 pages of 32 bytes (256 bits) per page with addresses for each byte. In hexadecimal the 512 bytes have 16-bit addresses that run from 0000 to 01FF. A control register (1 byte) has address 0200, and the SFR items have the following addresses:

The real-time clock (RTC) register and alarm register are located at address 0201–0205 and 020B–020F. The real-time clock is assigned address 0201–0205. The clock and alarm data is in binary format with the LSB equal 256th of a second. The total count of the 5 bytes is a calendar of 136 years. The alarm is a match of bits in the alarm bytes to the RTC bytes. The alarm registers are located 020B–020F.

The elapsed time and alarm registers are located at address 0206–020A and 0210–0214. The elapsed time registers will accumulate the time in binary format with the LSB=256th of a second. The elapsed time alarm (bytes 0210–0214) is programmed by the user and an alarm condition exists when the alarm byte count matches the elapsed time bytes count.

The cycle count registers require 3 bytes. These registers will accumulate the (binary) number of times the voltage at the I/O pin transitions from low to high level and back to a low level. One cycle is defined in the bit 7 Auto definition. These registers can be cleared only by the user writing "0"'s to these registers. The time base for counting cycles is determined by the DSEL bit 5.

In the presently preferred embodiment, there are three counter chains, each including 41-bit stages, but of course this number can readily be increased or decreased as desired. In fact, one of the advantages of the disclosed innovations is that they provide a fully saleable architecture for multiple counters of any size.

Note that two word lines run along each counter chain: one word line is used to address the stored count value, and one word line is used to address the stored alarm value. Also note that language regarding "pins" being in different "states" is used in this document to refer to pins receiving signals denoting different states.

Note that the one-bit counter stage also includes two bits of SRAM memory. One of these two cells is used to store the one-bit of count value for this stage, and one-bit is used to store the alarm value for this stage. The logic integrated in this counter stage includes a digital comparator, which will pull down the MATCH line if a match is not detected. (Thus, all of these digital comparator circuits are effectively wire-ANDed together, and an overall match will be detected if, and only if, a match is detected at every bit position.)

In addition to the MATCH line, taro other lines which run to every cell are FF2L and L2FF. When the line FF2L is driven active (high), each flip-flop will transfer its state to the corresponding gated latch. This latch can then be read out over the column line pair, by driving the time data word line.

In the presently preferred embodiment, separate FF2L and L2FF lines are provided for each of the three counter chains. However, alternatively, these lines could be connected to be common to all the counter chains.

In the presently preferred embodiment, the FF2L line is driven high at the start of any user-read operation. The protocol used, in the presently preferred embodiment, requires address arguments with any read command. Communication of these arguments, in the required serial protocol, provides enough time for any ongoing ripple through the counter to be completed, and for transfer of the counter data to the accessible latch cell of each stage, before the selected word line can go high to begin data access. (A signal Ripple_done is used, in the presently preferred embodiment, to indicate that any ongoing rippling should be completed.)

Thus, the consumption of battery charge caused by this operation is avoided, except when strictly necessary.

The L2FF signal is wired in a similarly parallel connection, but serves merely to provide a transfer in the opposite direction (from the accessible latch back to the flip-flop stage.)

Each stage provides a one-bit data output TRTC which clocks the next stage of the counter chain. The very first stage of the counter chain is clocked by a divided down signal that is clocked directly by the divided-down oscillator signal.

In the presently preferred embodiment, the first stage is clocked at a frequency of 256 Hertz, and the total number of stages is 40. Thus, this counter stage will not overflow for approximately 126 years. In the presently preferred embodiment, the RAM/counter array is laid out as two half arrays, with some peripheral logic in the center. (Of course, other subarray organizations can be used instead if desired.) However, in the presently preferred embodiment, the gap between the two half-arrays is used for insertion of a test clock signal into the TRTC and TECT lines. (A problem with long counter chains is that, even if a fast test clock is applied, the time to propagate this signal through the whole counter chain would be unacceptably long).

Note that each counter stage includes two gated latches: one of these holds one bit of the time data, and the other holds one bit of alarm data.

Figure 3:
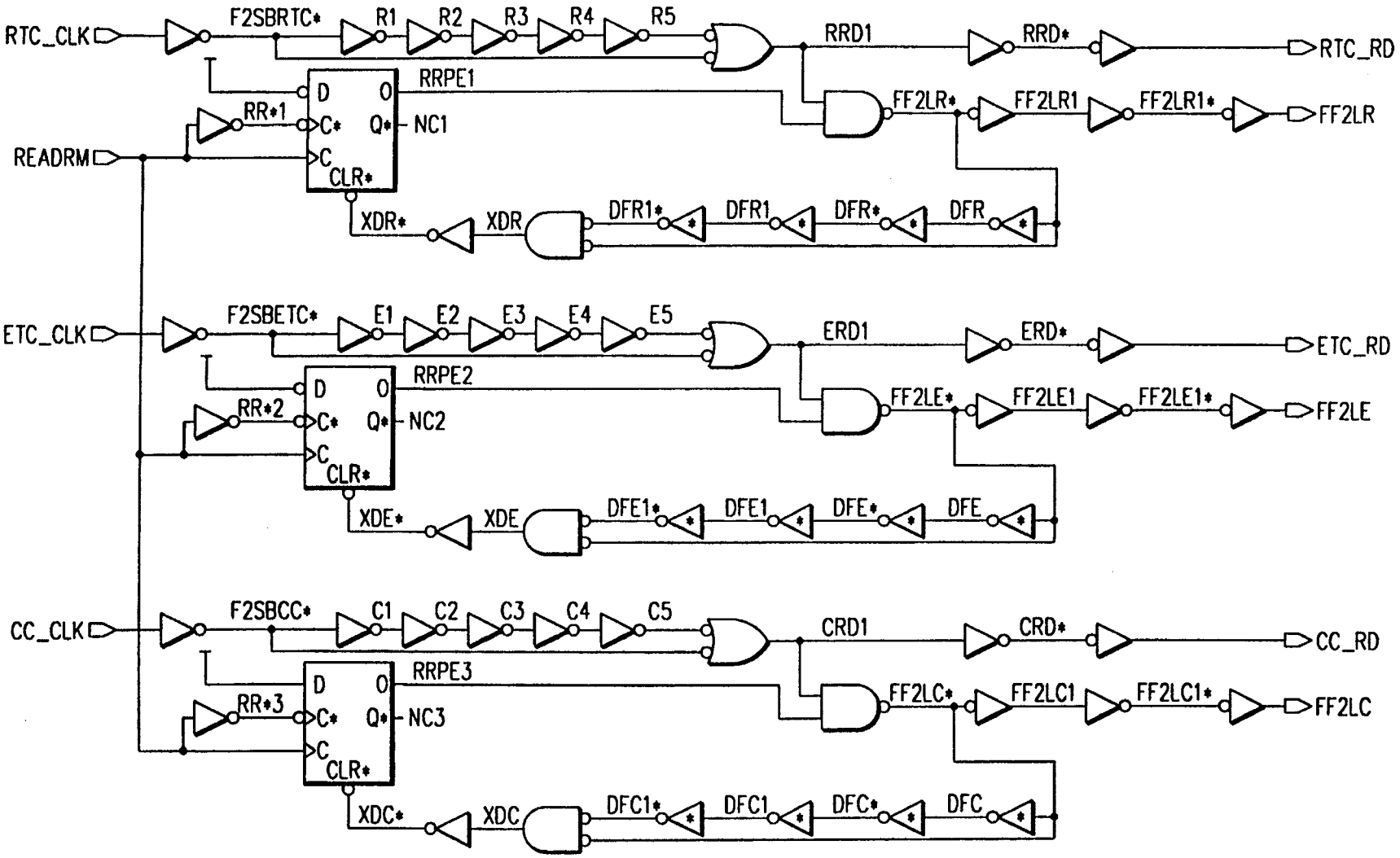
FIG. 3 shows the circuit organization of block XFER which is referred to in FIG. 2D.

FIG. 3 shows the circuitry used, in the presently preferred embodiment, to generate a parallel transfer signal (FF2L) at the start of every read operation.

FIGS. 2A–2F show the special function register block SFR, which was referred to in FIG. 1B. This block contains the three counter chains, with associated logic for accessing them. Note that this Figure contains sub-blocks SFDECODE, TSTOCB, XFER, MATCH, the real time counter chain (RTC00, RTC01, RTC02, RTC03, and RTC04), the elapsed time counter chain (ETC00, ETC01, ETC02, ETC03, and ETC04), the cycle counter chain (CC00, CC01, CC02, CC03), and CONTROL.

Figure 2A:
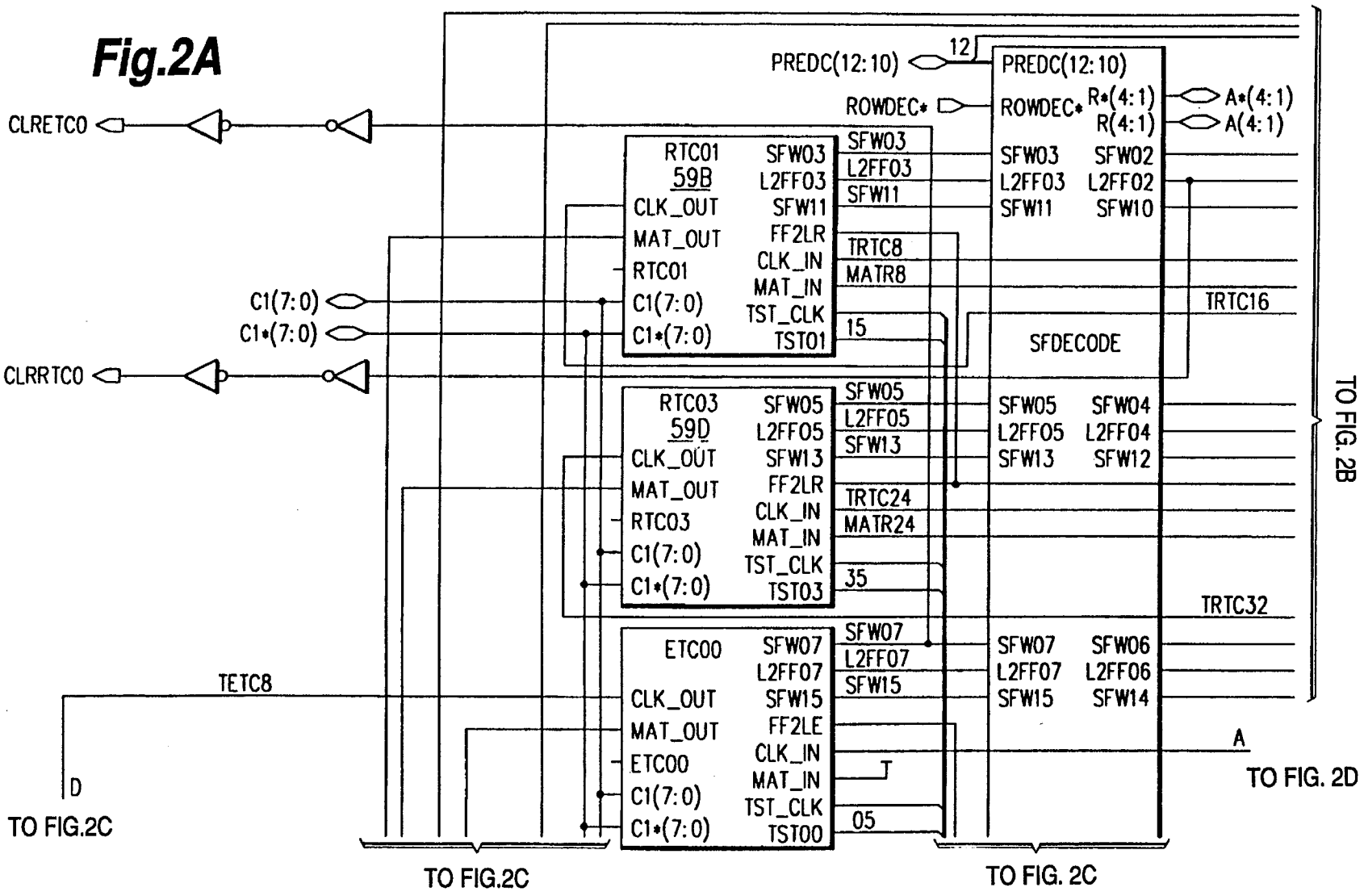
FIGS. 2A–2F show the special function register block SFR, which was referred to in FIG. 1B.
Figure 2B:
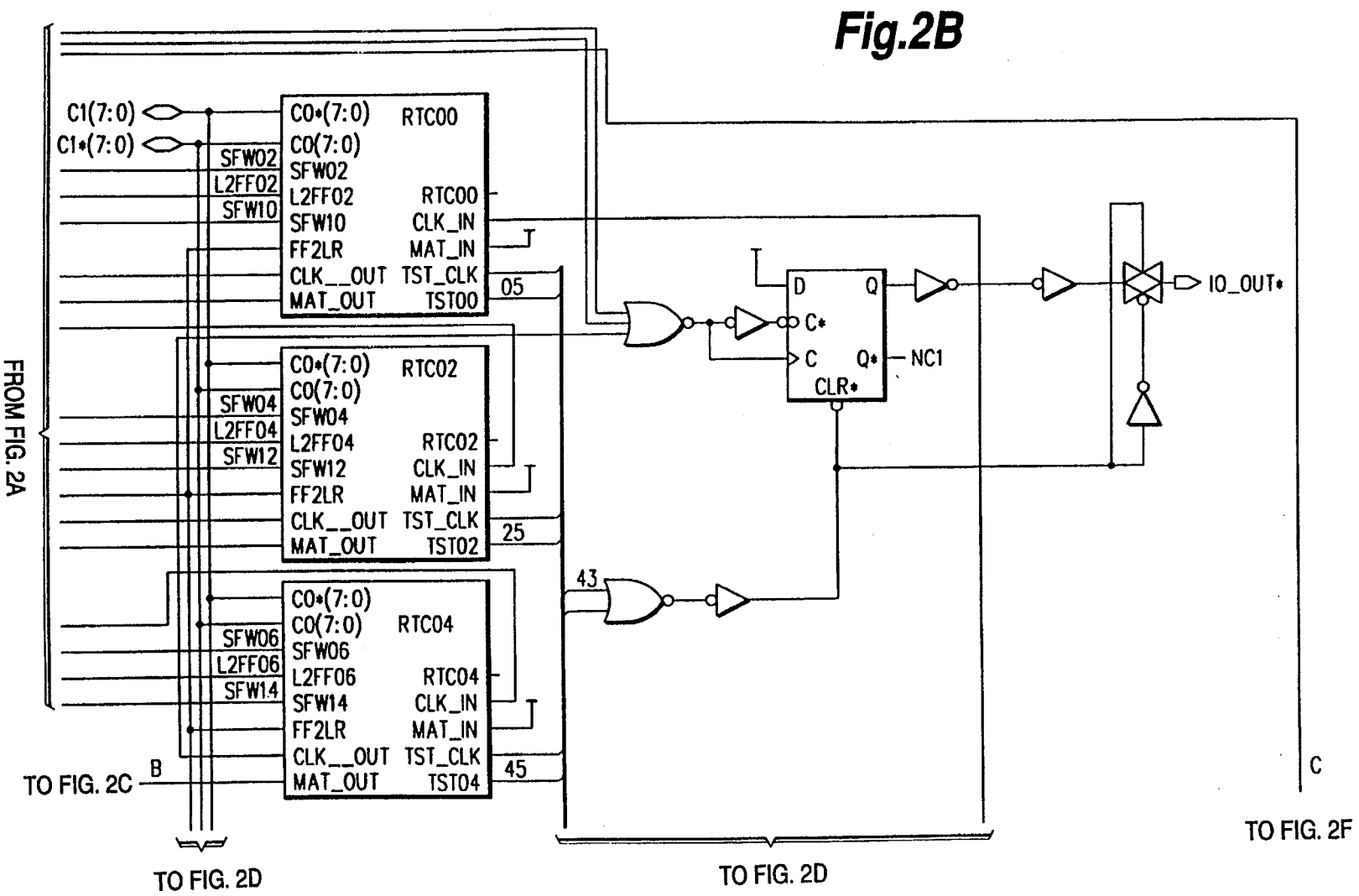
Figure 2C:
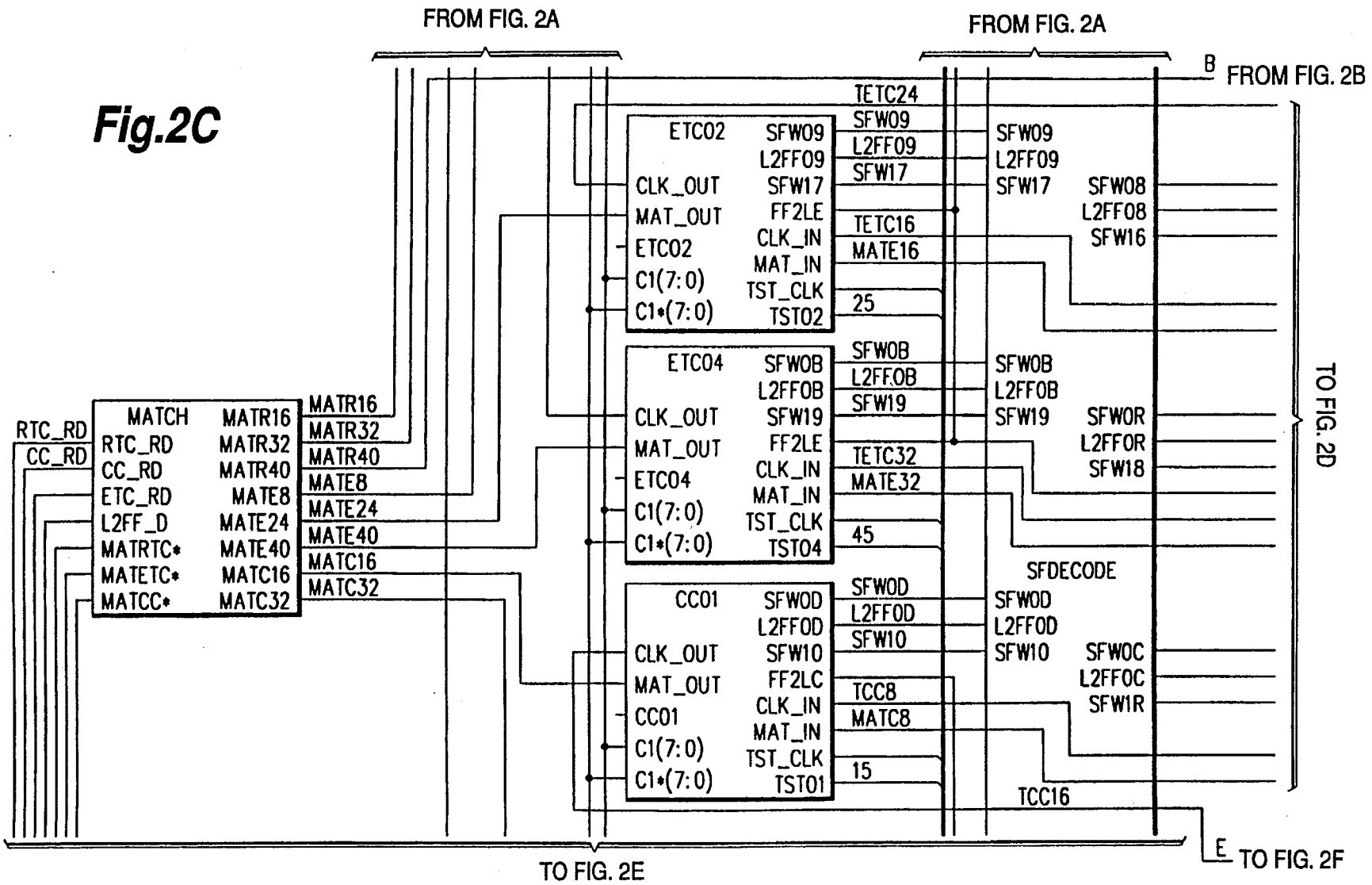
Figure 2D:
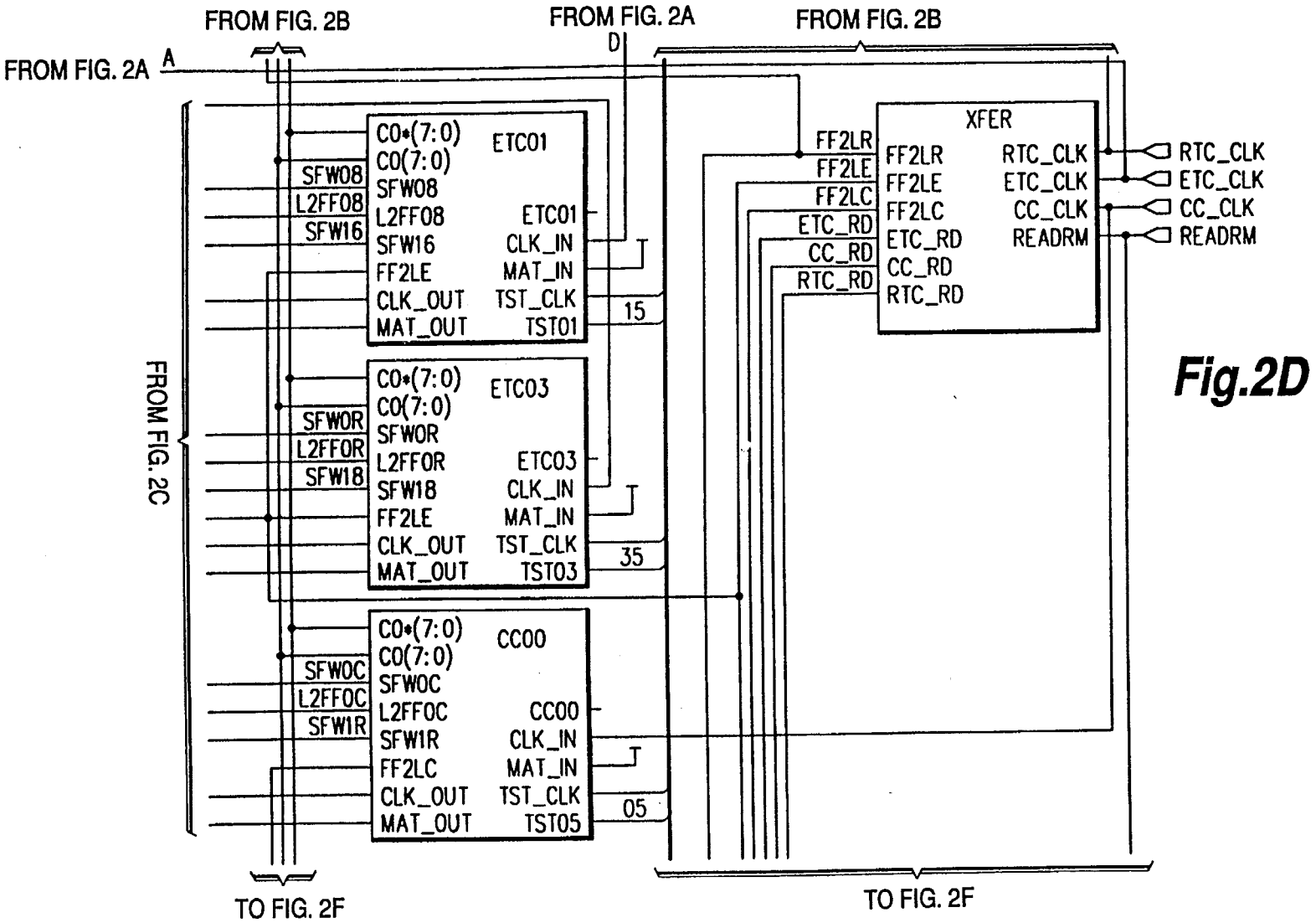

FIG. 3 shows the circuit organization of block XFER which is referred to in FIG. 2D. This circuitry receives a read-enable signal READRM, and the three clock signals RTC_CLK (for the real-time clock), ETC_CLK (for the elapsed-time clock), and CC_CLK (for the cycle counter). When an attempted user read occurs, the circuitry shown drives the appropriate FF2L line FF2LR, FF2LE, or FF2LC) high, as long as the corresponding ripple-done line (RTC_RD, ETC_RD, or CC_RD) has already gone high. (The FF2L is used to transfer the most current data into the user-accessible latches, as described elsewhere herein.)

Figure 2E:
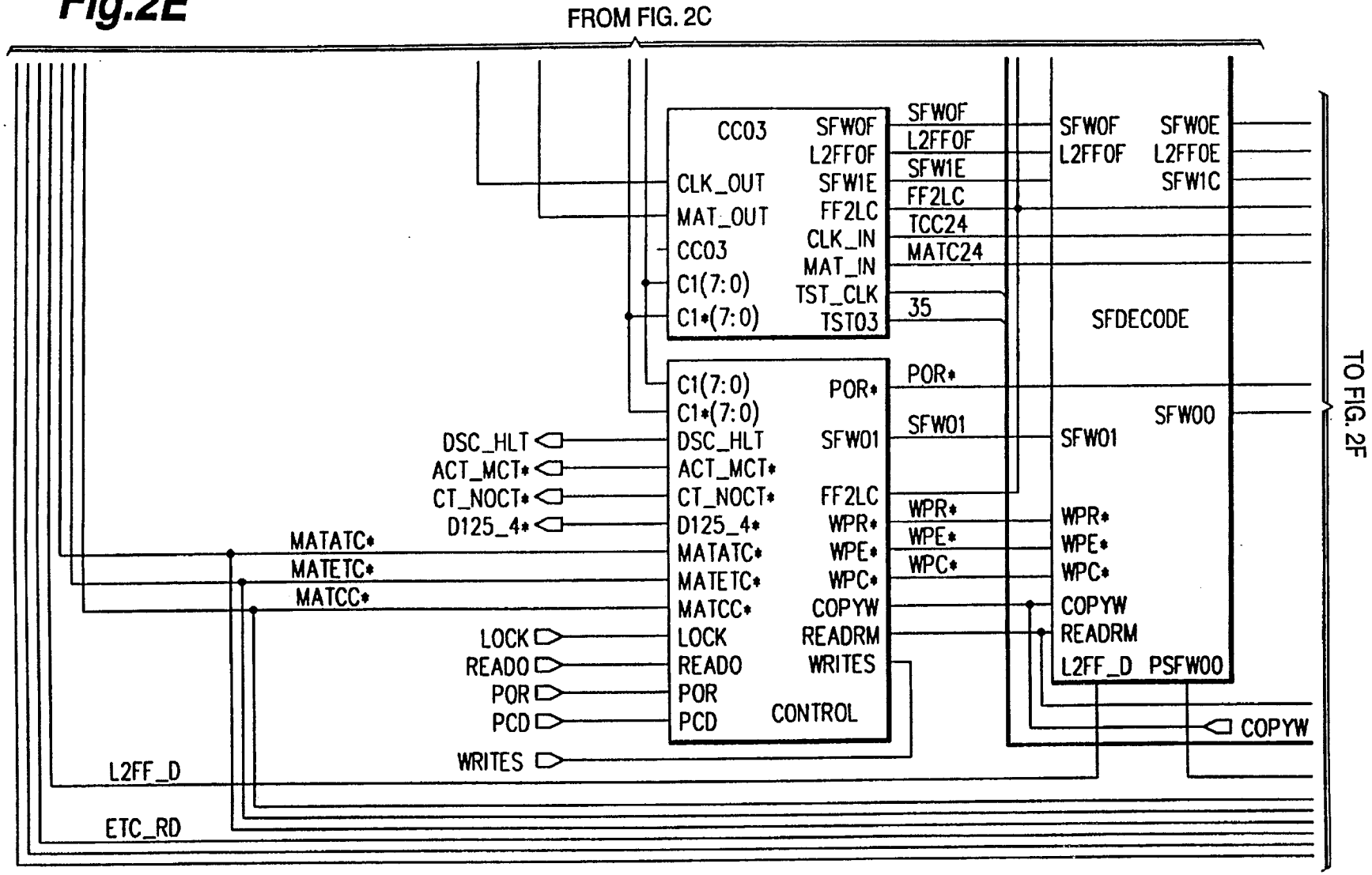
Figure 4:
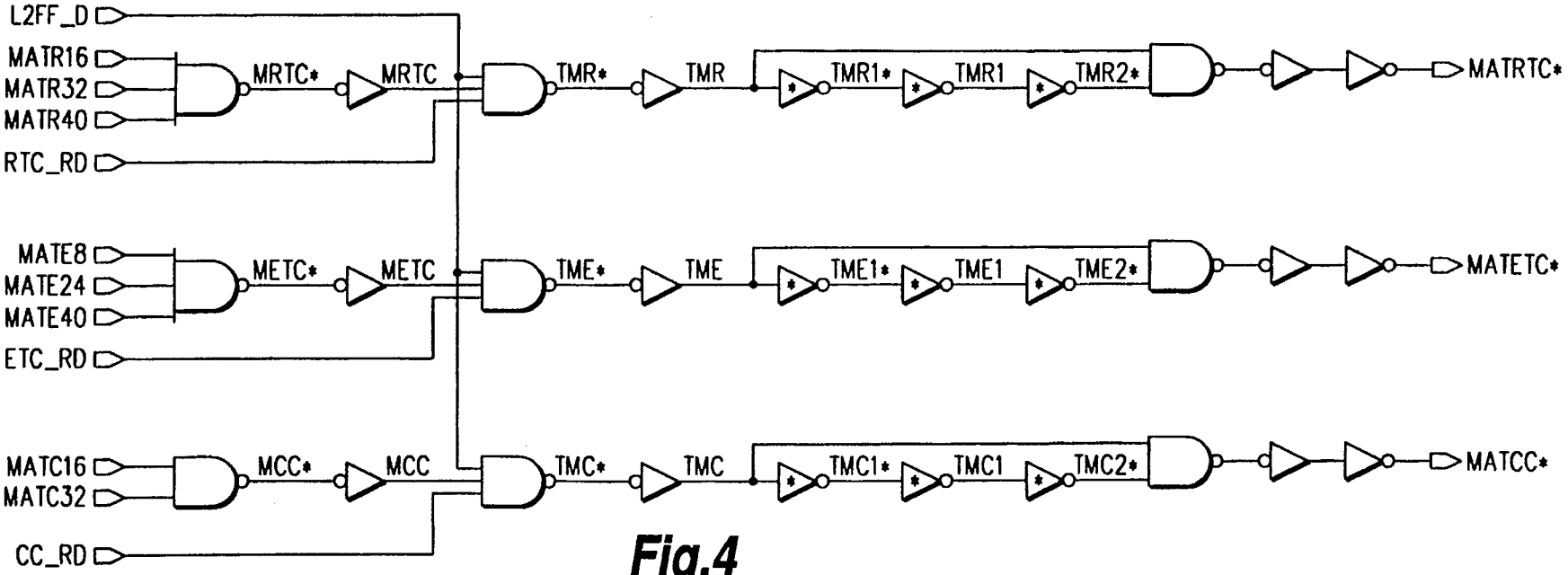
FIG. 4 shows the circuit organization of block MATCH, which was referred to in FIG. 2C. This block detects the occurrence of an alarm condition in any of the counters.

FIG. 4 shows the circuit organization of block MATCH, which was referred to in FIG. 2C. This block detects the occurrence of an alarm condition in any of the counters. ::

Circuit block SFDECODE, which was referred to in FIGS. 2A, 2C & 2E, merely contains straightforward decode logic.

Figure 2F:
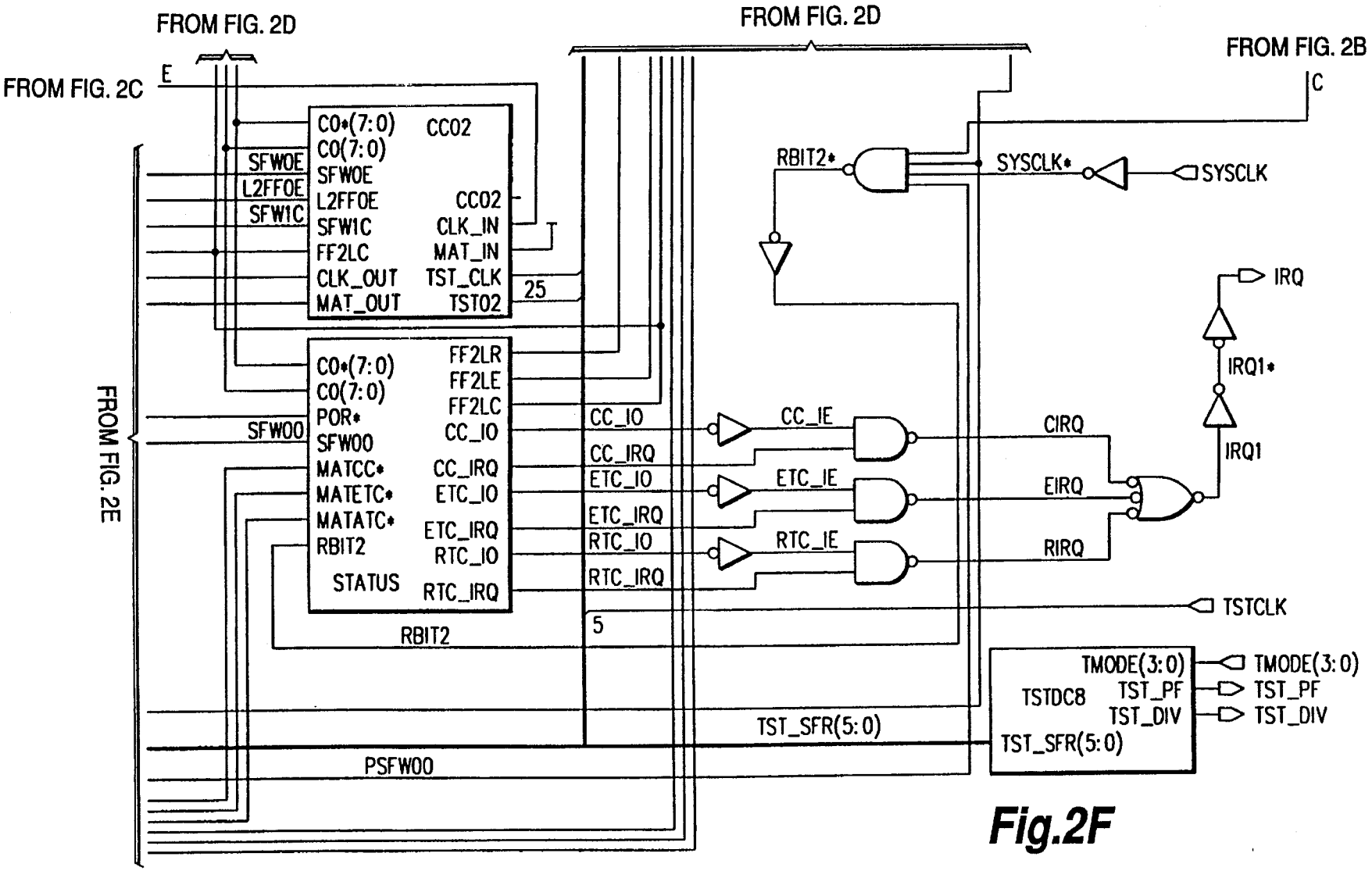

Circuit block TSTDC0, which was referred to in FIGS. 2A & 2C, is connected to decode a 4-bit test mode command TMODE in FIG. 2F, and accordingly to drive of the lines TST_SFR0–4, TST_PF, and/or TST_DIV.

Circuit block STATUS, which was referred to in FIG. 2F, is simply a collection of 8 latches (3 of them resettable).

Figure 5A:
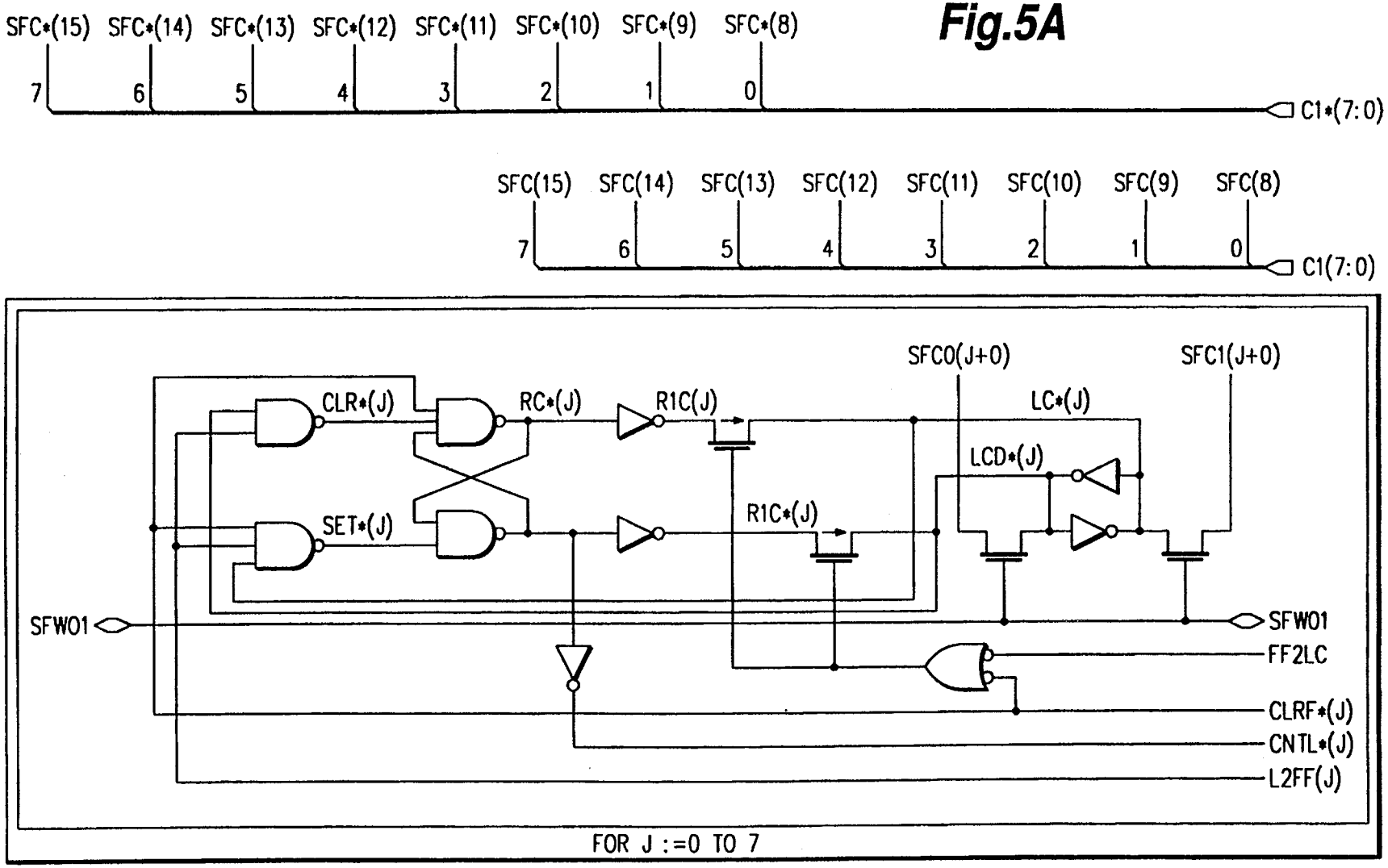
FIGS. 5A–5C show the circuit organization of block CONTROL, which was referred to in FIG. 2E. In addition to performing routine control functions, note that this circuitry generates a signal LOCK when a match occurs within any of the three counters.
Figure 5B:
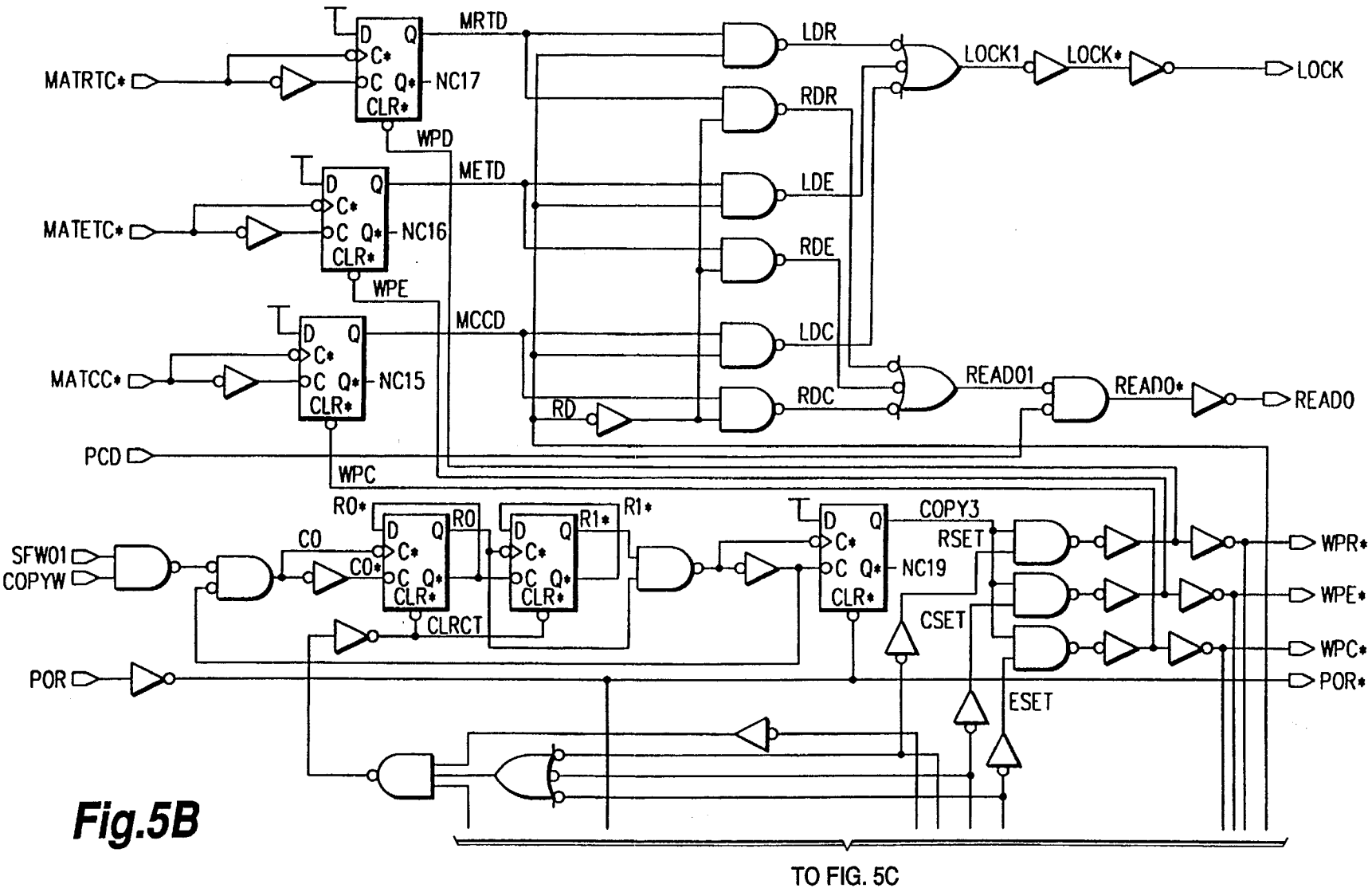
Figure 5C:
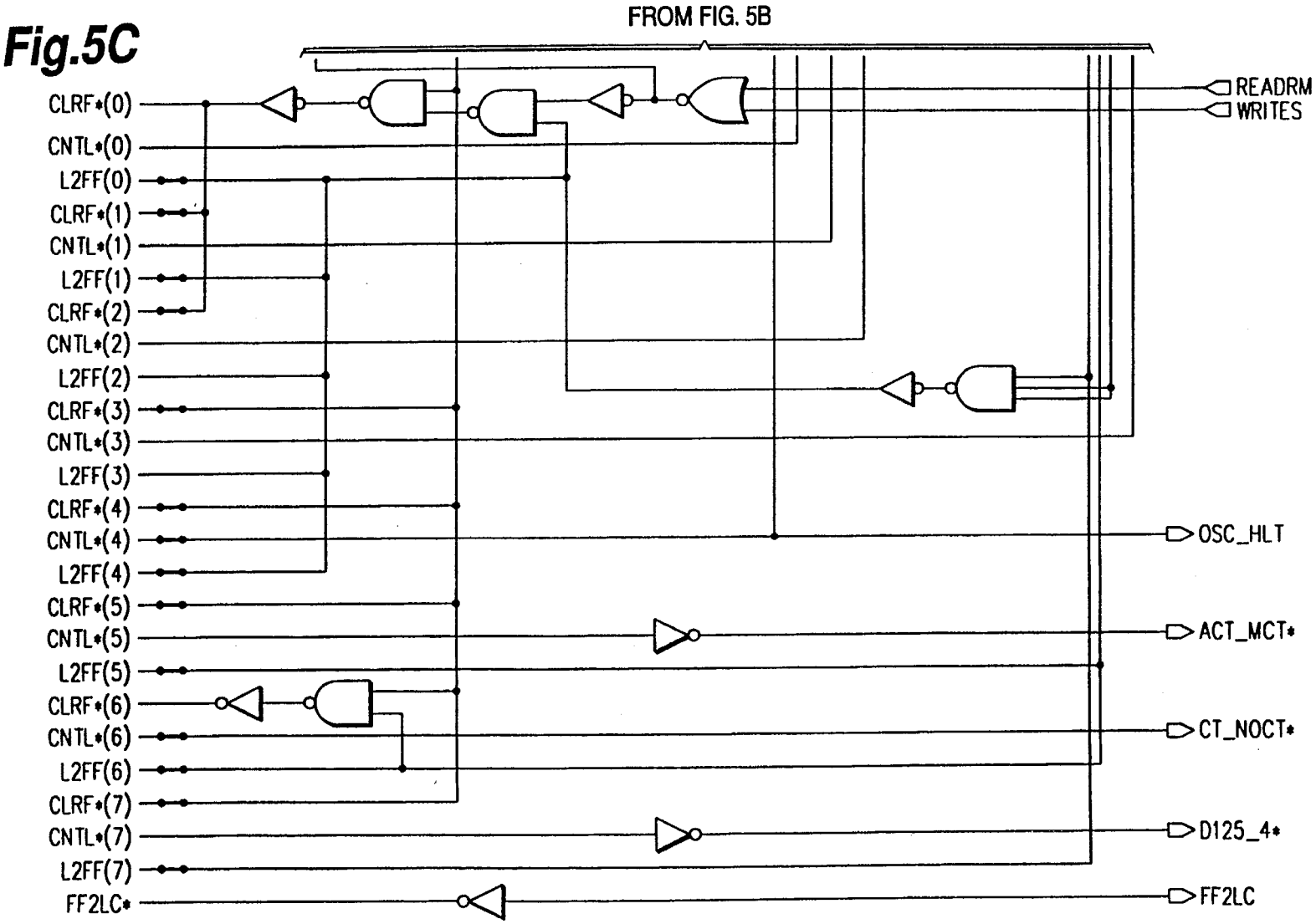

FIGS. 5A–5C show the circuit organization of block CONTROL, which was referred to in FIG. 2E. In addition to performing routine control functions, note that this circuitry generates a signal LOCK when a match occurs within any of the three counters.

Figure 6:
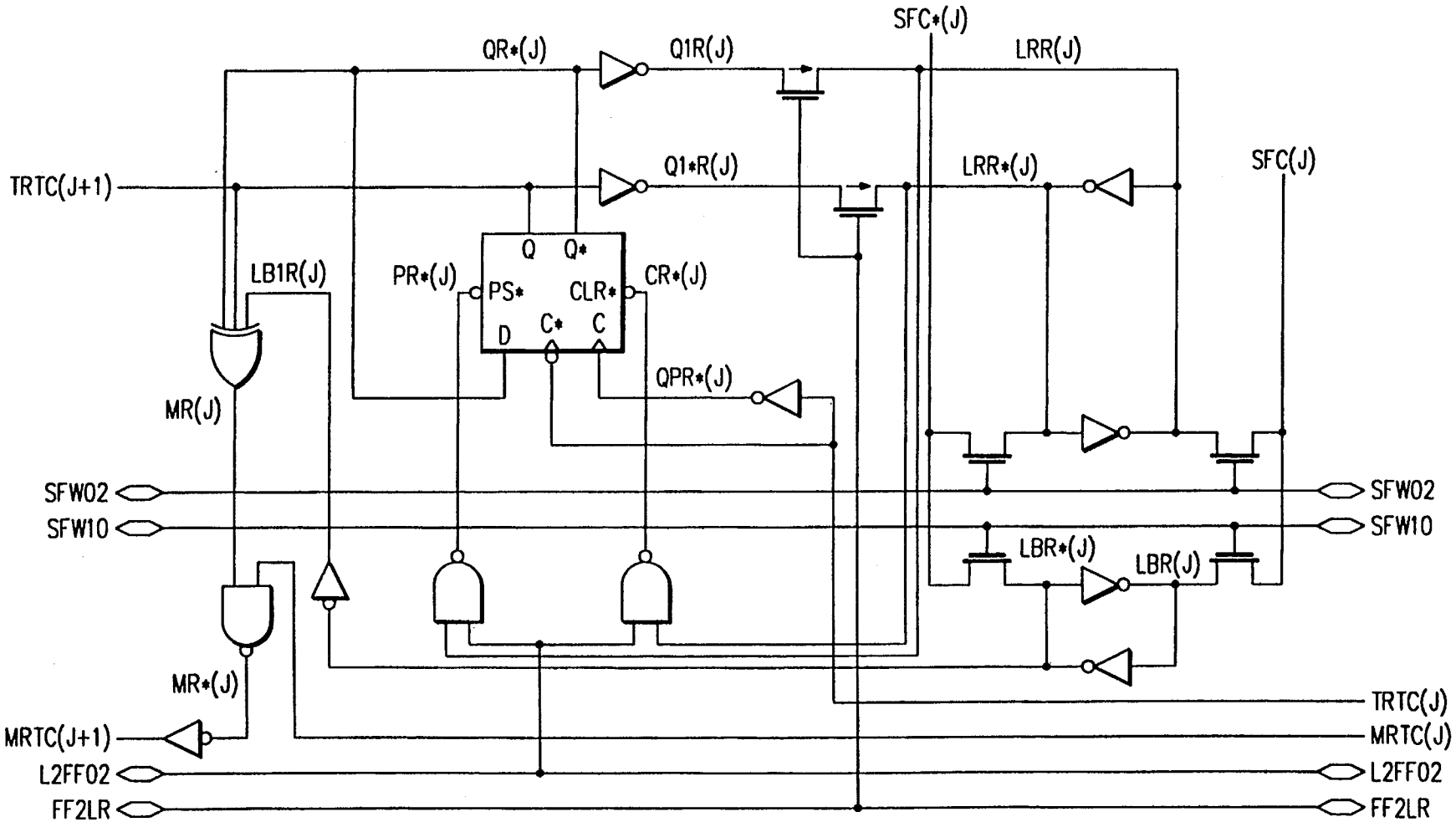
FIG. 6 shows the actual detailed implementation of one bit of these counter chains.

Circuit blocks RTC00–04, ETC00–04, and CC00–03 are simply the three counter chains. FIG. 6 shows the actual detailed implementation of one bit of these counter chains. The lines MRTC are chained together to provide a match-detect signal MAT_OUT.

Circuit block PF, which was referred to in FIG. 1A, simply compares the backup battery voltage VBATB against the system supply voltage VCC, and accordingly generates a power-fail warning signal PF, which is received by circuit block DIV.

Circuit block POR, which was referred to in FIG. 1A, generates an on-chip reset signal POR, which is routed to the other circuit blocks.

Circuit block OSC, which was referred to in FIG. 1B, is a crystal-controlled oscillator. In the presently preferred embodiment, this is essentially the same as that described in U.S. Pat. No. 4,871,982, which is hereby incorporated by reference.

Circuit block DIV, which was referred to in FIG. 1A, divides down the output of the oscillator block OSC, to produce the real-time-clock increment pulses RTC_CLK at 256 Hz. This block also produces elapsed-time-clock pulses ETC_CLK conditionally, and cycle-counter pulses CC_CLK when transitions are detected (as described elsewhere herein), and handles oscillator-halt commands.

Circuit block CNTL, which was referred to in FIG. 1B, contains a large amount of miscellaneous logic of no particular interest. This logic is simply straightforward implementations of the various functions described herein.

What is claimed is:

1. An integrated circuit, comprising:

an oscillator which produces tick signals at a constant average frequency;

first counter system connected to said oscillator, which first counter system counts said tick signals to provide a current time value;

a second counter system connected to said oscillator and to a first input pin, which second counter system counts said tick signals only when said first input pin is in a first state;

third counter system connected to a second input pin, which third counter system is incremented each time said second input pin transactions into a second state;

interface circuitry which provides read access to said first, second, and third counter systems; and a system power input pin and a battery input pin, and wherein said first and second input pins are said system power input pin, and said first state occurs whenever power is applied to said system power supply input pin, and wherein said first counter system is powered from said battery input pin when said system power input pin is not powered.

2. A subsystem, comprising:

an integrated circuit, including:

an oscillator which produces tick signals at a constant average frequency;

a first counter system which is connected to said oscillator and which counts said tick signals to provide a current time value;

a second counter system which is connected to said oscillator and a first input pin and which counts said tick signals only when said first input pin is in a first state;

a third counter system which is connected to said oscillator and a second pin and which is incremented each time said second pin transitions into a second state; and interface circuitry which provides read access to said first, second, and third counter systems, a resonant crystal connected to stabilize the frequency of said oscillator; and a battery connected to power said integrated circuit;

wherein said integrated circuit is connected so that said first counter system counts continuously, and said first pin is in said first state when power is being applied to said subsystem, and said second pin transitions into said second state when power is applied to power up said subsystem.

3. The subsystem of claim 2, wherein said first and second pins are the same, and said first state is the same as said second state.

4. The subsystem of claim 2, wherein said first and second pins are the same.

5. The subsystem of claim 2, wherein said oscillator comprises a divider which divides down an output of said oscillator to produce a resulting frequency which is lower than $2^{12}$ ticks per second.

6. The subsystem of claim 2, further comprising a system power input pin and a battery input pin, and wherein said first and second input pins are said system power input pin, and said first state occurs whenever power is applied to said system power supply input pin, and wherein said first counter is powered from said battery input pin when said system power input pin is not powered.

7. The subsystem of claim 2, wherein said battery powers said integrated circuit continuously.

* * * * *